US009587551B2

(12) United States Patent
Kitahara et al.

(10) Patent No.: US 9,587,551 B2
(45) Date of Patent: Mar. 7, 2017

(54) COOLANT PASSAGE STRUCTURE FOR INTERNAL COMBUSTION ENGINE

(71) Applicant: HONDA MOTOR CO., LTD., Tokyo (JP)

(72) Inventors: Shuichi Kitahara, Wako (JP); Takahiro Yamauchi, Wako (JP); Yusuke Kato, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 125 days.

(21) Appl. No.: 14/529,150

(22) Filed: Oct. 31, 2014

(65) Prior Publication Data

US 2015/0122204 A1 May 7, 2015

(30) Foreign Application Priority Data

Nov. 1, 2013 (JP) ..... 2013-228502
Feb. 14, 2014 (JP) ..... 2014-026044

(51) Int. Cl.
*F01P 5/12* (2006.01)
*F01P 11/04* (2006.01)
*F01P 11/08* (2006.01)

(52) U.S. Cl.
CPC ..... *F01P 5/12* (2013.01); *F01P 11/04* (2013.01); *F01P 11/08* (2013.01)

(58) Field of Classification Search
CPC ..... F01P 5/12; F01P 2003/008; F01P 5/04; F04D 29/126; F04D 1/00
(Continued)

(56) References Cited

U.S. PATENT DOCUMENTS 3,162,136 A * 12/1964 Clary ..... F04D 29/426 277/370
3,163,157 A * 12/1964 Connell ..... F01P 5/10 123/41.09
(Continued)

FOREIGN PATENT DOCUMENTS

CN 103122791 5/2013
JP 61-059834 U 4/1986
(Continued)

OTHER PUBLICATIONS

Japanese Office Action for corresponding JP Application No. 2014-026044, Oct. 27, 2015.
(Continued)

*Primary Examiner* — Long T Tran
(74) *Attorney, Agent, or Firm* — Mori & Ward, LLP

(57) ABSTRACT

A coolant passage structure for an internal combustion engine includes a coolant communication member. The coolant communication member includes a centrifugal water pump, a housing portion, a scroll portion, a second coolant passage portion, a first coolant passage portion, a direction of a center line of the second coolant passage portion, and a rib. The first coolant passage portion includes a downstream region connected to an upstream region of the second coolant passage portion. A direction of a center line of the first coolant passage portion is parallel to a direction of a rotation shaft of the centrifugal water pump. The direction of the center line of the second coolant passage portion is orthogonal to the direction of the center line of the first coolant passage portion. The rib is disposed on an internal circumferential surface of the first coolant passage portion.

22 Claims, 9 Drawing Sheets

(58) Field of Classification Search
USPC ..... 123/41.33, 41.34, 41.44–41.47, 41.49, 123/41.6, 41.63; 415/111, 148, 185, 186, 415/223 B, 231, 56.1, 197, 201, 203, 223
See application file for complete search history.

(56) References Cited

U.S. PATENT DOCUMENTS 3,193,890 A * 7/1965 Clary ..... F04D 29/426 164/340
3,778,181 A * 12/1973 McFarlin ..... F04D 9/02 415/197
4,004,541 A * 1/1977 Onal ..... B63H 11/08 416/184
4,643,652 A * 2/1987 Eberhardt ..... F01N 3/04 251/315.08
4,690,613 A * 9/1987 Eberhardt ..... F02B 63/06 251/315.08
6,632,071 B2 * 10/2003 Pauly ..... F04D 29/282 416/185
7,008,177 B2 * 3/2006 Britt ..... F04D 29/128 415/111
7,131,420 B2 * 11/2006 Ito ..... F01L 1/024 123/195 A

FOREIGN PATENT DOCUMENTS

| | | | |
|---|---|---|---|
| JP | 05-087297 | U | 11/1993 |
| JP | 3342398 | B2 | 10/1999 |
| JP | 2007-09784 | A | 1/2007 |
| JP | 2013-108385 | | 6/2013 |

OTHER PUBLICATIONS

Chinese Office Action for corresponding CN Application No. 201410596741.0, Aug. 3, 2016 (w/ English machine translation).

* cited by examiner

COOLANT PASSAGE STRUCTURE FOR INTERNAL COMBUSTION ENGINE

CROSS-REFERENCE TO RELATED APPLICATIONS

The present application claims priority under 35 U.S.C. §119 to Japanese Patent Application No. 2013-228502, filed Nov. 1, 2013, entitled "Coolant Passage Structure for Internal Combustion Engine" and Japanese Patent Application No. 2014-026044, filed Feb. 14, 2014, entitled "Coolant Passage Structure for Internal Combustion Engine." The contents of these applications are incorporated herein by reference in their entirety.

BACKGROUND

1. Field

The present disclosure relates to a coolant passage structure for an internal combustion engine.

2. Description of the Related Art

An enormous amount of coolant is supplied to a vehicle-mounted internal combustion engine. If a large pressure drop exists in a coolant system through which that enormous amount of coolant flows, a sufficient cooling ability is not obtainable, and a large water pump and coolant passage are needed. Various examples of water pumps and coolant passage structures are proposed (see, for example, Japanese Patent No. 3342398 and Japanese Unexamined Patent Application Publication No. 2013-108385).

The structure described in Japanese Patent No. 3342398 aims to improve the rigidity of a bracket for mounting auxiliary machinery parts and to cool the auxiliary machinery parts using a coolant passage. That patent literature discloses a water pump, a first coolant passage upwardly extending from a pump chamber in the water pump along a mounting base, and a second coolant passage bent toward a cylinder block from the upper end of the first coolant passage.

The structure described in Japanese Unexamined Patent Application Publication No. 2013-108385 aims to reduce the entire size of an internal combustion engine by arranging auxiliaries, including a water pump, in a compact manner. That patent literature discloses the water pump and a recessed passage forming a downstream-side coolant passage extending from a pump chamber in the water pump toward a cylinder head, being curved at a curved middle portion, extending upwardly, and reaching a coolant supply part at an upper site.

SUMMARY

According to one aspect of the present invention, a coolant passage structure for an internal combustion engine enables coolant to be supplied to a coolant passage in the internal combustion engine. The coolant passage structure includes a coolant communication member accommodating a centrifugal water pump and being attached to the internal combustion engine. The coolant communication member includes a housing portion, a scroll portion, a first coolant passage portion, and a second coolant passage portion. The housing portion accommodates an impeller of the centrifugal water pump. The scroll portion links to the housing portion and includes a downstream region connected to the first coolant passage portion. The first coolant passage portion is positioned above the downstream region of the scroll portion. The first coolant passage portion includes a downstream region connected to an upstream region of the second coolant passage portion. The second coolant passage portion is cylindrical. The second coolant passage portion includes a downstream region connected to the coolant passage in the internal combustion engine. A direction of a center line of the first coolant passage portion is parallel to a direction of a rotation shaft of the centrifugal water pump. A direction of a center line of the second coolant passage portion is orthogonal to the direction of the center line of the first coolant passage portion. A rib for adjusting the coolant flowing inside the first coolant passage portion is disposed on an internal circumferential surface of the first coolant passage portion.

According to another aspect of the present invention, a coolant passage structure for an internal combustion engine includes a coolant communication member. The coolant communication member includes a centrifugal water pump, a housing portion, a scroll portion, a second coolant passage portion, a first coolant passage portion, a direction of a center line of the second coolant passage portion, and a rib. The housing portion accommodates an impeller of the centrifugal water pump. The scroll portion is connected to the housing portion and includes a downstream region. The second coolant passage portion is cylindrical and includes a downstream region connected to a coolant passage in the internal combustion engine. The coolant passage structure is configured to supply coolant to the coolant passage. The first coolant passage portion includes a downstream region connected to an upstream region of the second coolant passage portion. The downstream region of the scroll portion is connected to the first coolant passage portion which is positioned above the downstream region of the scroll portion. A direction of a center line of the first coolant passage portion is parallel to a direction of a rotation shaft of the centrifugal water pump. The direction of the center line of the second coolant passage portion is orthogonal to the direction of the center line of the first coolant passage portion. The rib is disposed on an internal circumferential surface of the first coolant passage portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
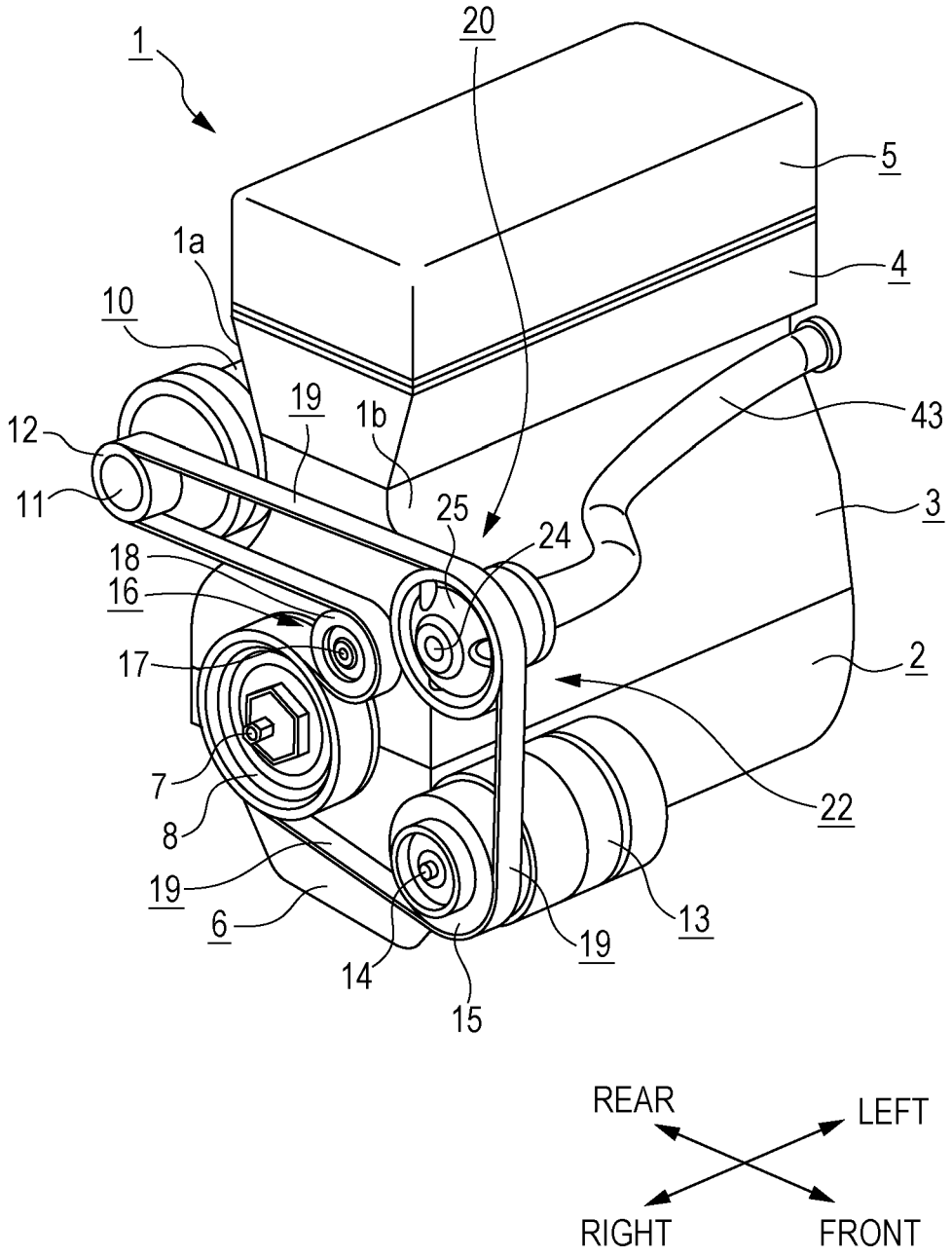
FIG. 1 is an overall perspective view, partly omitted from illustration, of an internal combustion engine according to a first embodiment.

The embodiments will now be described with reference to the accompanying drawings, wherein like reference numerals designate corresponding or identical elements throughout the various drawings.

A first embodiment is described below with reference to FIGS. 1 to 10.

As illustrated in FIG. 1, an internal combustion engine 0 according to the present embodiment is a water-cooled four-stroke in-line four-cylinder internal combustion engine and is transversely mounted on a vehicle such that a crankshaft 7 is directed in the leftward-rightward direction of the vehicle.

In the present specification, the front, rear, left, and right of the vehicle are defined in relation to the direction of travel of the vehicle.

As illustrated in FIG. 1, an engine body 1 of the internal combustion engine 0 has an integrated structure of a cylinder block 3, a lower case 2, a cylinder head 4, and a cylinder cover 5. The cylinders (not illustrated) directed in the upward-downward direction are arranged in the leftward-rightward direction in the cylinder block 3. The lower case 2 is connected to the lower portion of the cylinder block 3 with a bearing (not illustrated) disposed therebetween such that the crankshaft 7 is sandwiched therebetween. The cylinder head 4 and the cylinder cover 5 are stacked in order on the cylinder block 3.

An AC generator 10, which is an auxiliary component, is attached to a right portion of a rear side surface 1*a* of the engine body 1.

A centrifugal water pump 22 and an air-conditioning compressor 13, which are auxiliary components, are attached to a right portion of a front side surface 1*b* of the engine body 1. The centrifugal water pump 22 is disposed above the air-conditioning compressor 13.

The centrifugal water pump 22 is connected to a first end of a connecting pipe 43. The connecting pipe 43 includes a second end extending along the front side surface 1*b* toward the left of the engine body 1 and connected to a thermostat 42 described below.

A drive pulley 8 fit on an end of the crankshaft 7 is arranged on the right side surface of the engine body 1. A tensioner pulley rotation shaft 17 is arranged obliquely above the drive pulley 8 and is nearer the front. A tensioner pulley 18 is supported on the tensioner pulley rotation shaft 17. The tensioner pulley 18 is rotatably biased toward the front by an arm (not illustrated).

A generator pulley 12 is fit on an end of a generator rotation shaft 11 projecting rightward from the AC generator 10. A water pump pulley 25 is fit on an end of a water pump rotation shaft 24 projecting rightward from the centrifugal water pump 22. A compressor pulley 15 is fit on an end of a compressor shaft 14 projecting rightward from the air-conditioning compressor 13.

The drive pulley 8, tensioner pulley 18, generator pulley 12, water pump pulley 25, and compressor pulley 15 are arranged on the same vertical plane. An endless belt 19 is stretched around the drive pulley 8, tensioner pulley 18, generator pulley 12, water pump pulley 25, and compressor pulley 15 in this order. The tensioner pulley 18 provides the endless belt 19 with a tension.

The AC generator 10, centrifugal water pump 22, and air-conditioning compressor 13, which are the auxiliary components, are simultaneously driven by movement of the endless belt 19 caused by rotation of the drive pulley 8.

Figure 2:
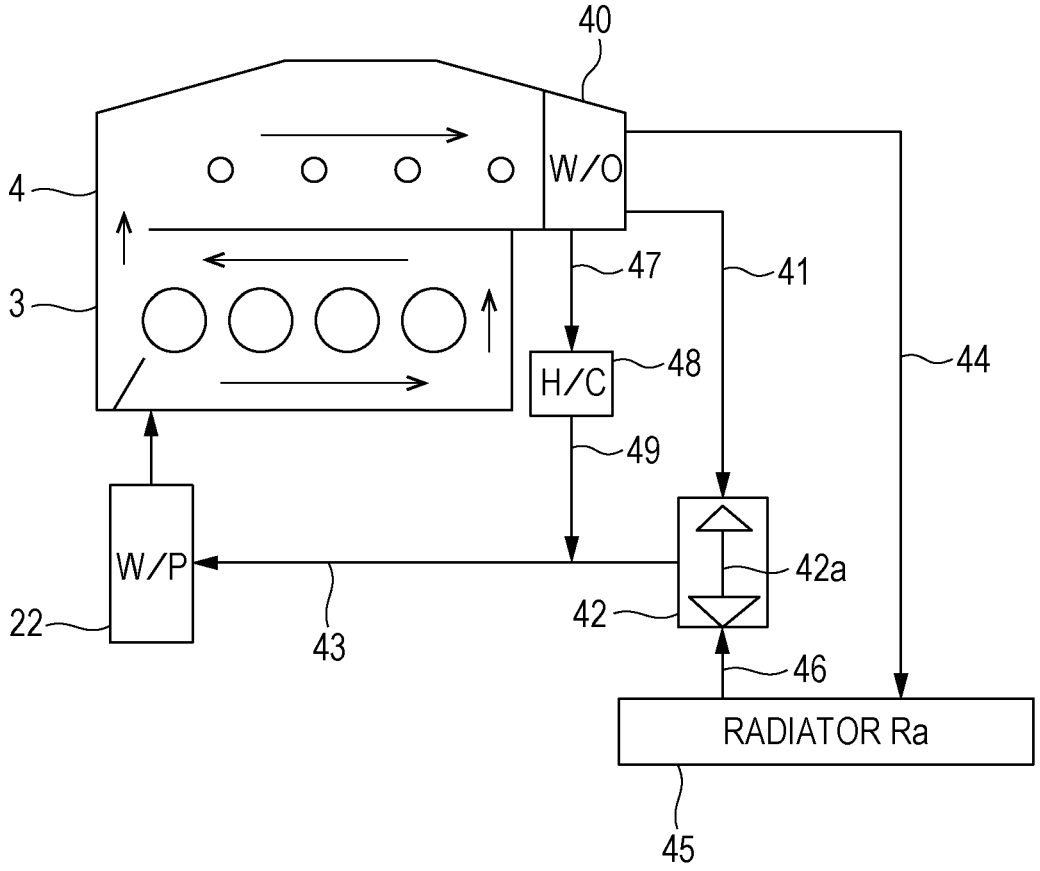
FIG. 2 is a schematic diagram of a coolant system in the internal combustion engine.

A main circulation path in a cooling system in which coolant is circulated by operation of the centrifugal water pump 22 is briefly described below with reference to the schematic diagram in FIG. 2.

The coolant discharged from the centrifugal water pump 22 passes through a water jacket (not illustrated) in the cylinder block 3, then flows into the cylinder head 4, which is disposed above the cylinder block 3, passes through a water jacket (not illustrated) in the cylinder head 4, and flows into a water outlet 40. When the engine is cold, the coolant flows into the thermostat 42 through a bypass path 41, is caused to flow into the centrifugal water pump 22 through the connecting pipe 43 by a temperature sensing portion of the thermostat 42, and circulates.

When the coolant flowing into the water outlet 40 is heated to a temperature higher than that in the state in an operation for the cold engine, a valve body 42*a* in the thermostat 42 moves upward and blocks the bypass path 41. At the same time, the water outlet 40 enters a state in which it communicates with the centrifugal water pump 22 through a radiator inflow channel 44, a radiator 45, a radiator outflow channel 46, the thermostat 42, and the connecting pipe 43. The coolant flowing into the water outlet 40 passes through the radiator inflow channel 44, radiator 45, radiator outflow channel 46, thermostat 42, and connecting pipe 43, flows into the centrifugal water pump 22, and circulates. In this way, the cylinder block 3 and cylinder head 4 in the internal combustion engine 0 are cooled to a proper temperature.

In addition, in a normal operation state, part of the coolant flowing into the water outlet 40 passes through a heater inflow channel 47, a heater core 48, a heater outflow channel 49, and the connecting pipe 43 and flows into the centrifugal water pump 22. Thus, in heating use, air inside a vehicle is heated to a proper temperature by the heater core 48.

A coolant passage structure 20 for an internal combustion engine is described next. The coolant passage structure 20 is a main portion in the embodiments.

A coolant communication member 21 accommodating the centrifugal water pump 22 is attached to the engine body 1 of the internal combustion engine 0 mounted as a power source on a four-wheel car or other vehicle. The coolant communication member 21 includes a housing portion 23 accommodating an impeller 26 of the centrifugal water pump 22, a scroll portion 27, a first coolant passage portion 28, and a second coolant passage portion 29. The scroll portion 27 links to the housing portion 23 and includes a downstream end connected to an upstream end of the first coolant passage portion 28. The first coolant passage portion 28 is positioned above the downstream end of the scroll portion 27. The first coolant passage portion 28 includes a downstream end connected to an upstream end of the second coolant passage portion 29. The second coolant passage portion 29 includes a downstream end connected to a coolant passage (not illustrated) inside the cylinder block 3 and the cylinder head 4 in the internal combustion engine 0. The water pump rotation shaft 24 oriented in the vehicle width direction is rotatably supported on the housing portion 23. The impeller 26 is integrally fit on an end of the water pump rotation shaft 24.

The coolant communication member 21 is divided into a pump block 21*a* supporting the water pump pulley 25 through the water pump rotation shaft 24 and a coolant passage block 21*b* disposed on a side projecting from the tip of the impeller 26.

Figure 3:
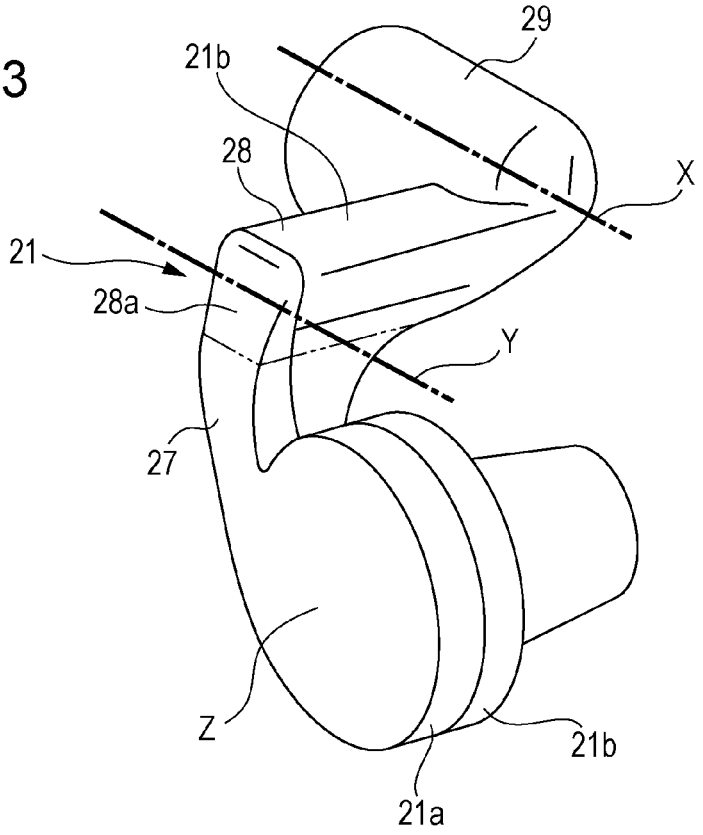
FIG. 3 is a perspective view of a coolant passage in a coolant communication member.
Figure 4:
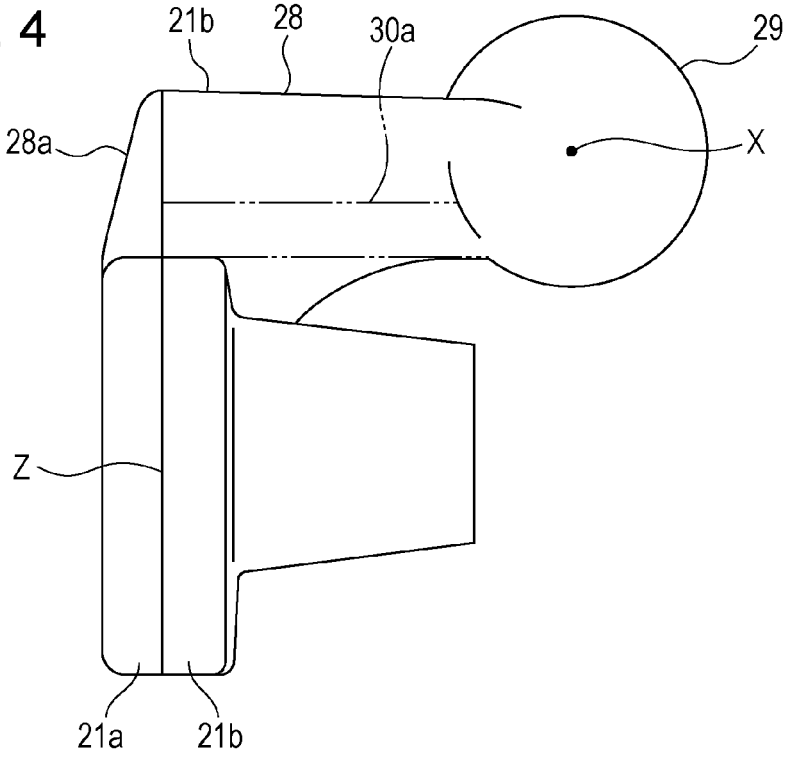
FIG. 4 is a right side view of the coolant passage illustrated in FIG. 3.

As illustrated in FIGS. 3 and 4, a line Y being in contact with an upstream end surface 28*a* of the first coolant passage portion 28 is parallel to a center line X of the second coolant passage portion 29. The upstream end surface 28*a*, which is parallel to the line Y, of the first coolant passage portion 28 is inclined toward the downstream region of the first coolant passage portion 28 along a direction from a trailing end of the scroll portion 27 to the upper part of the first coolant passage portion 28 with respect to a surface Z of revolution of the impeller 26.

Figure 5:
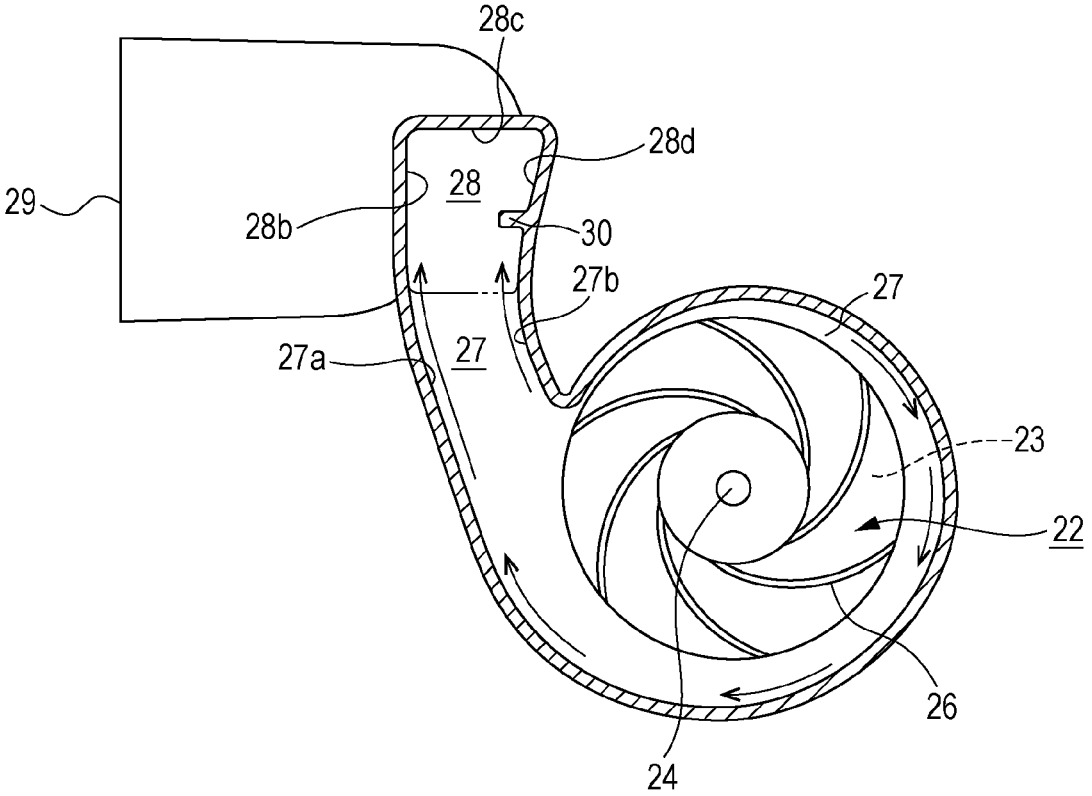
FIG. 5 is a cross-sectional view of a scroll portion and a first coolant passage portion in the coolant passage in cross section orthogonal to a rotation shaft of a water pump.
Figure 6:
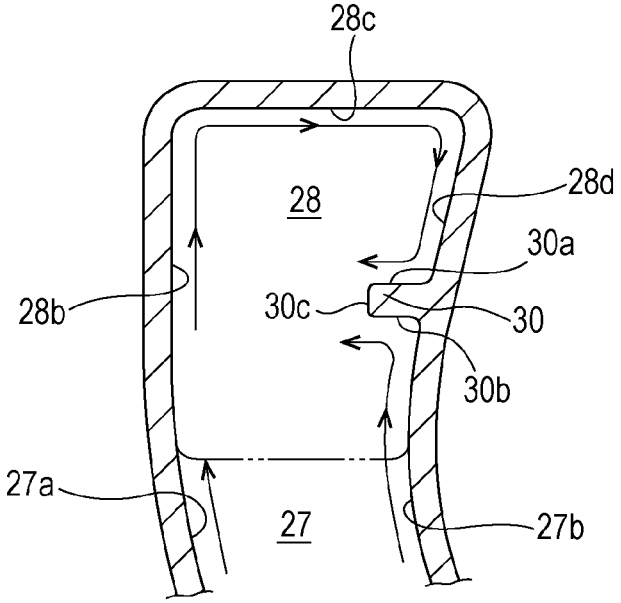
FIG. 6 is a main cross-sectional view of the state illustrated in FIG. 5.
Figure 7:
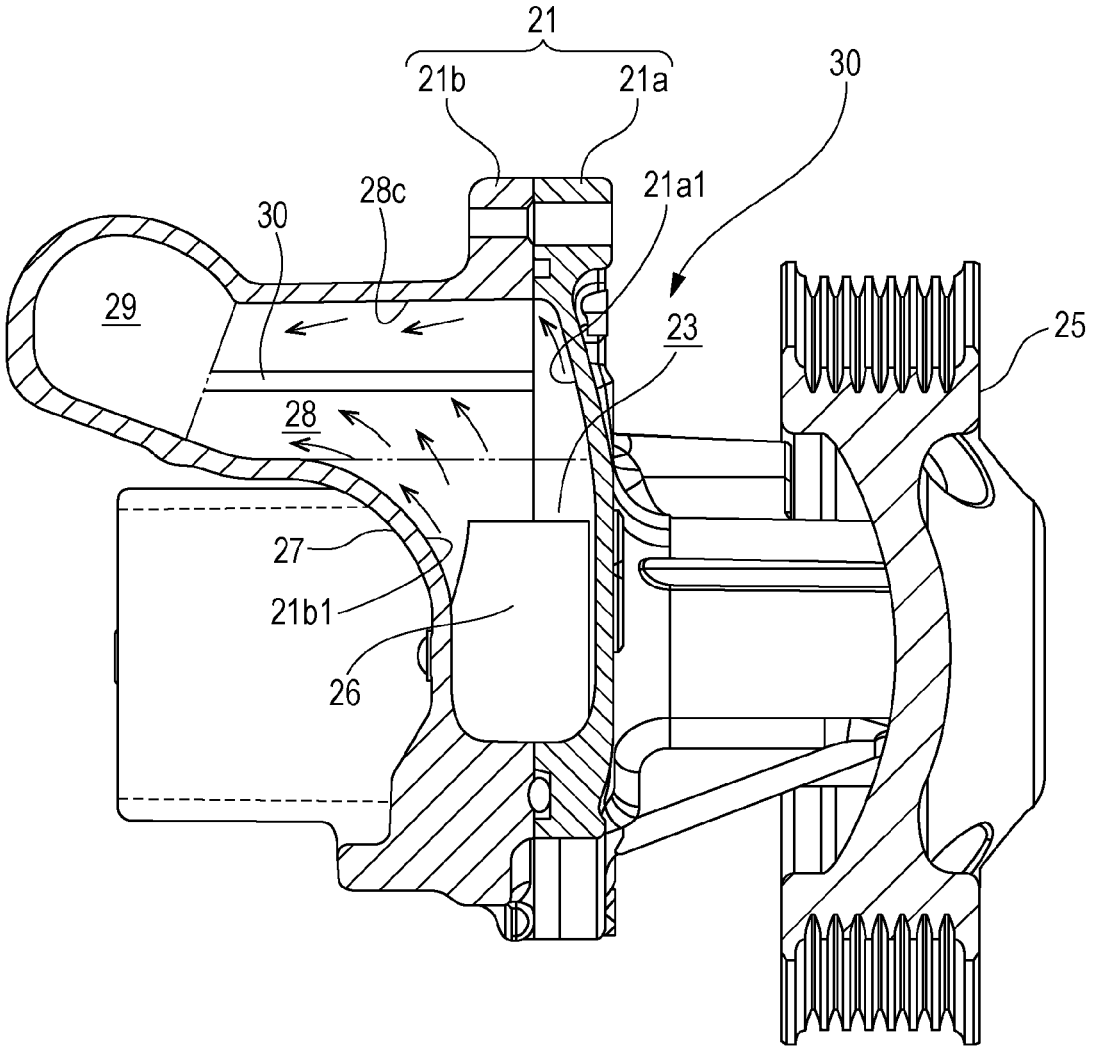
FIG. 7 is a cross-sectional view of the coolant communication member taken along a center line of the first coolant passage portion.

As illustrated in FIGS. 5, 6, and 7, the direction of the center line of the first coolant passage portion 28 is parallel to the water pump rotation shaft 24 for the centrifugal water pump 22 and is orthogonal to the center line in the vertical direction of the trailing end on the downstream end of the scroll portion 27. The direction of the center line of the second coolant passage portion 29 is parallel to the surface of revolution orthogonal to the water pump rotation shaft 24 and is orthogonal to the direction of the center line of the first coolant passage portion 28.

The internal circumferential surface of the first coolant passage portion 28 includes two opposite surfaces as seen in a direction parallel to the direction extending along the center line of the first coolant passage portion 28. One of the two opposite surfaces that is remote from the housing portion 23 is defined as an outer surface, and the other surface opposed to that outer surface is defined as an inner surface. A rib 30 for adjusting the coolant flowing inside the first coolant passage portion 28 is disposed on the inner surface in the first coolant passage portion 28. The rib 30 is long and narrow and extends substantially in parallel to the center line of the first coolant passage portion 28.

The rib 30 may extend slightly upward or downward toward the downstream region inside the first coolant passage portion 28 oriented horizontally as seen in the direction of the center line of the second coolant passage portion 29.

As illustrated in FIG. 7, the rib 30 is disposed in only the coolant passage block 21*b* in the coolant communication member 21.

Figure 8:
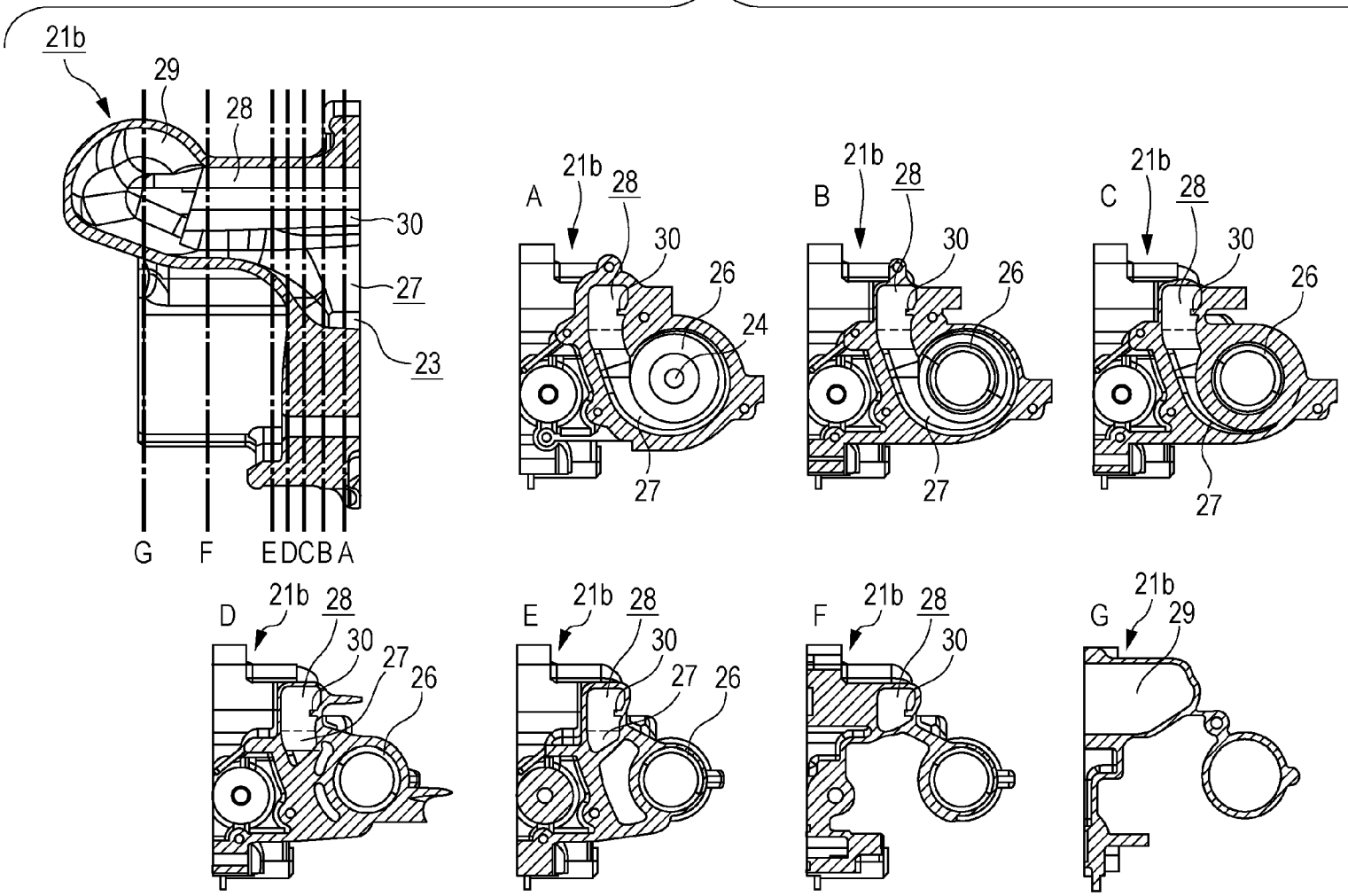
FIG. 8 includes cross-sectional views of a coolant passage block taken along vertical planes in sequence.

As illustrated in FIG. 8, the rib 30 has a substantially rectangular transverse section in any location in the direction of the center line of the first coolant passage portion 28. As illustrated in FIG. 6, the rib 30 is formed in transverse section such that a rib top surface 30*a* and rib bottom surface 30*b* are substantially parallel to a top surface 28*c* of the first coolant passage portion 28.

The rib 30 is set such that, as seen in the direction along the center line of the first coolant passage portion 28, the ratio of the amount B of protrusion of the rib 30 to the distance A between the inner surface and the outer surface of the first coolant passage portion 28 is in the range of 12% to 49%.

Figure 9:
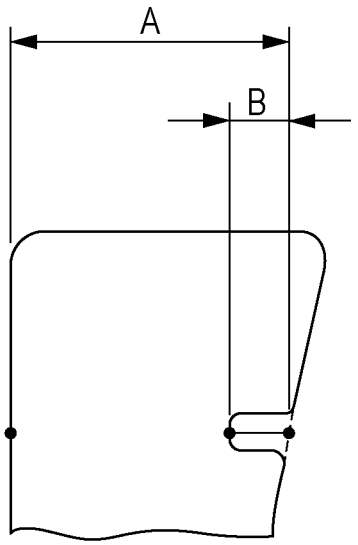
FIG. 9 is a main-part enlarged view that illustrates a positional relationship between the amount of protrusion of a rib and each of an inner surface and an outer surface of the first coolant passage portion.
Figure 10:
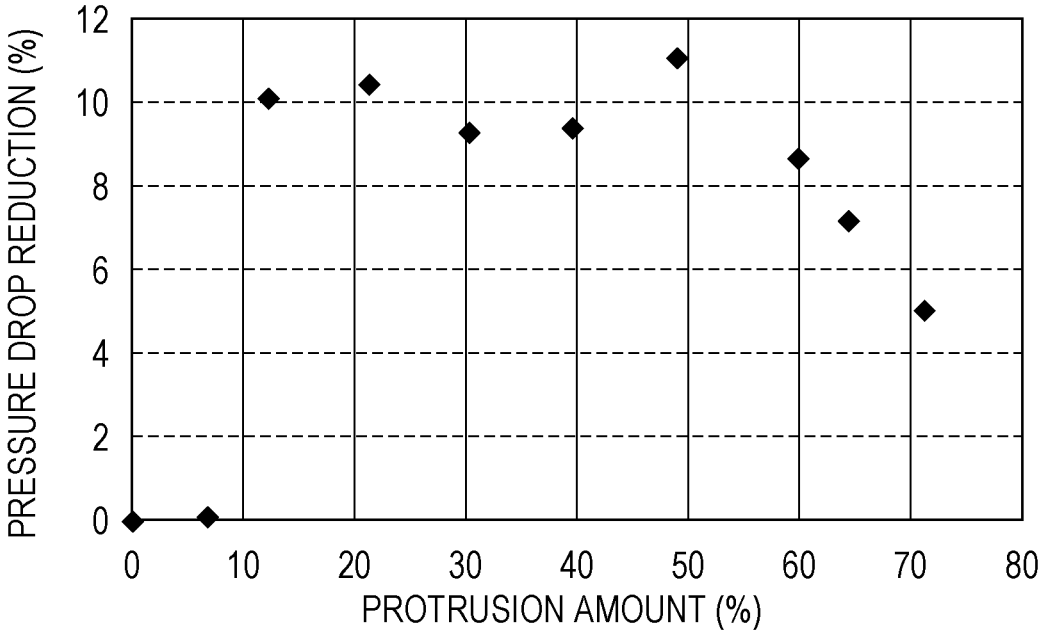
FIG. 10 is a graph that illustrates a relationship between the ratio of a protrusion amount B of the rib to a distance A between the inner surface and the outer surface of the first coolant passage portion and the pressure drop reduction in coolant.

FIG. 10 is a graph that illustrates a relationship between the ratio of the amount B of protrusion of the rib 30 to the distance A between the inner surface and the outer surface of the first coolant passage portion 28 illustrated in FIG. 9 (this ratio is hereinafter referred to as "protrusion amount") and the reduction in pressure drop in coolant (hereinafter referred to as "pressure drop reduction"). The data is obtained by simulation of the pressure drop reduction in the coolant passage from the scroll portion 27 to the second coolant passage portion 29 using flow analysis employing computational fluid dynamics (CFD) with respect to the protrusion amount when the distance between the inner surface and the outer surface of the first coolant passage portion 28 is fixed.

FIG. 10 reveals that the pressure drop reduction significantly increases when the protrusion amount is 12% and decreases when it exceeds 60%. In particular, when the protrusion amount is in the range of 12% to 49%, the pressure drop reduction is at high values of approximately 10%.

Accordingly, when the protrusion amount of the rib is in the range of 12% to 49%, the pressure drop in streams from the scroll portion 27 to the second coolant passage portion 29 can be effectively reduced.

As illustrated in FIGS. 4 and 7, as seen in the direction of the center line of the second coolant passage portion 29, the center line of the coolant stream flowing above from the rib top surface 30*a* of the rib 30 inside the first coolant passage portion 28 oriented horizontally is set in a location substantially intersecting the center line of the second coolant passage portion 29.

The scroll portion 27 includes a scroll-portion external circumferential surface 27*a* remote from the water pump rotation shaft 24 and a scroll-portion internal circumferential surface 27*b* near the water pump rotation shaft 24 in its inside in the downstream region. A coolant flowing along the scroll-portion external circumferential surface 27*a* flows from a first side surface 28*b*, which is the outer surface of the first coolant passage portion 28, to a second side surface 28*d*, which is the inner surface thereof, through the top surface 28*c* and thus becomes a clockwise swirling flow. Another coolant flowing along the scroll-portion internal circumferential surface 27*b* becomes an upward flow flowing upward along the second side surface 28*d* of the first coolant passage portion 28. If the clockwise swirling flow and the upward flow collide with each other at the rib 30, this collision tends to cause a large pressure drop in the coolant streams.

In the present embodiment, however, as illustrated in FIG. 6, the direction of the coolant flowing from the scroll-portion external circumferential surface 27*a* to the first side surface 28*b* and flowing to the second side surface 28*d* of the first coolant passage portion 28 along the top surface 28*c* is changed by the rib top surface 30*a* of the rib 30 to the direction toward the second coolant passage portion 29, and the direction of the coolant flowing upward from the scroll-portion internal circumferential surface 27*b* of the scroll portion 27 along the second side surface 28*d* of the first coolant passage portion 28 is changed by the rib bottom surface 30*b* of the rib 30 to the direction toward the second coolant passage portion 29. Thus both of the upper and lower streams flow toward the second coolant passage portion 29 without colliding with each other. As a result, the pressure drop caused by the collision of the coolant streams significantly decreases.

In addition, as illustrated in FIG. 5, in a coolant course along the scroll-portion external circumferential surface 27*a* of the scroll portion 27, the distance from the leading end of the scroll portion 27 to the trailing end connected to the first coolant passage portion 28 is long, the speed of the stream is high, and a large amount of the coolant flows upward toward the first side surface 28*b* of the first coolant passage portion 28. At the top surface 28*c*, it flows toward the second side surface 28*d*. At the second side surface 28*d*, it flows downward and also flows toward the downstream end of the first coolant passage portion 28 along the scroll-portion external circumferential surface 27*a* of the scroll portion 27, as illustrated in FIG. 7. As a result, due to both the streams, the coolant flowing along the second side surface 28*d* of the first coolant passage portion 28 is apt to flow in an oblique downward direction between the direction toward the second coolant passage portion 29 and the downward direction.

The coolant flowing into the first coolant passage portion 28 along the scroll-portion internal circumferential surface 27*b* of the scroll portion 27 is also apt to flow in an oblique upward direction between the direction toward the second coolant passage portion 29 and the upward direction because of the same reason as for the coolant flowing into the scroll-portion external circumferential surface 27*a* of the scroll portion 27. If the rib 30 does not exist on the second side surface 28*d* in the first coolant passage portion 28, the upward and downward streams of the coolant would merge with each other obliquely, and this merging would increase the pressure drop. When the rib 30 exists on the second side surface 28*d*, the advantage of reducing the pressure drop resulting from that merging is obtainable.

Next, a second embodiment in which the first embodiment further includes an oil cooler 50 is described.

The internal combustion engine 0 is equipped with the oil cooler 50. The oil cooler 50 is a water-cooled oil cooler configured to cool engine oil heated inside the internal combustion engine 0 by exchanging heat with the engine oil using coolant supplied into the oil cooler 50.

In the present embodiment, as illustrated in FIGS. 4 and 7, as seen in the direction of the center line of the second coolant passage portion 29, the center line of a coolant stream flowing above the rib top surface 30*a* of the rib 30 disposed in the first coolant passage portion 28 oriented horizontally is set in a location substantially intersecting the center line of the second coolant passage portion 29.

Figure 11:
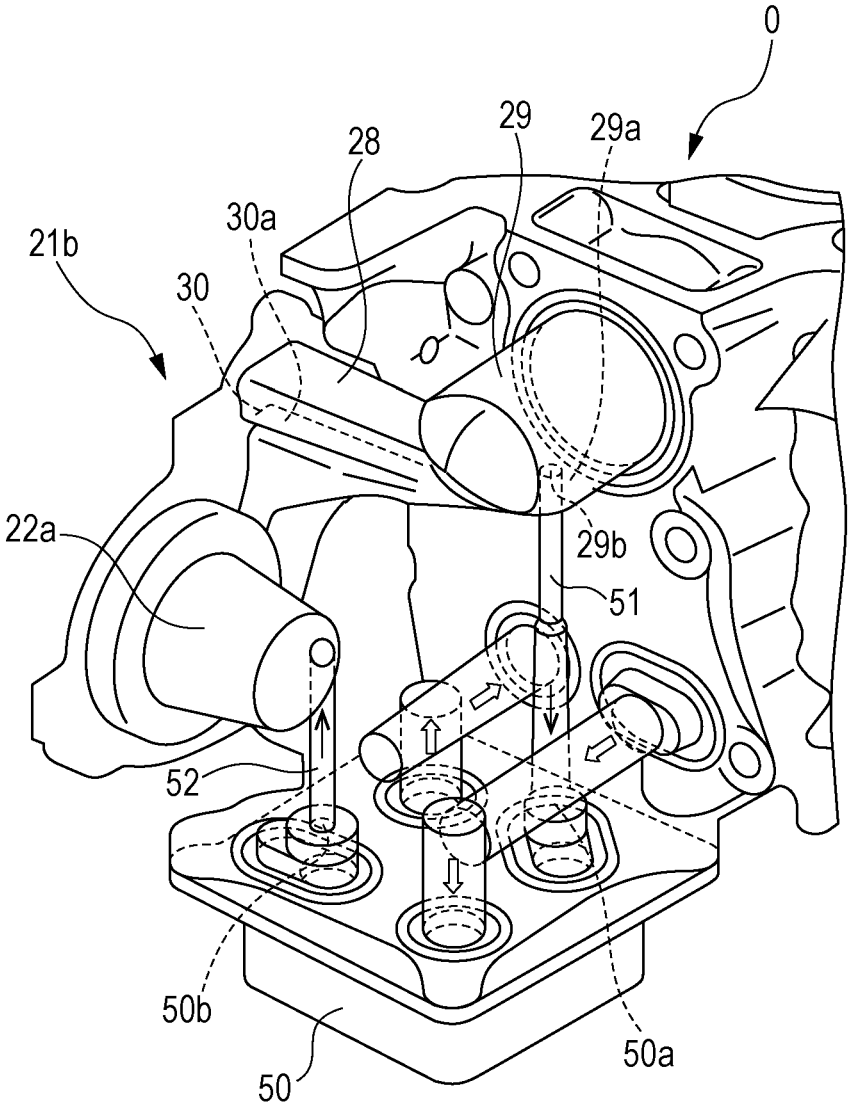
FIG. 11 is a perspective view of a coolant passage in a coolant communication member according to a second embodiment.

FIG. 11 is a perspective view of a coolant passage in the coolant communication member 21 according to the second embodiment. FIG. 11 illustrates the connection state between the inside of the coolant communication member 21 and the oil cooler 50, with which the internal combustion engine 0 is equipped, in a way in which part of the connection state is transparent.

Figure 12:
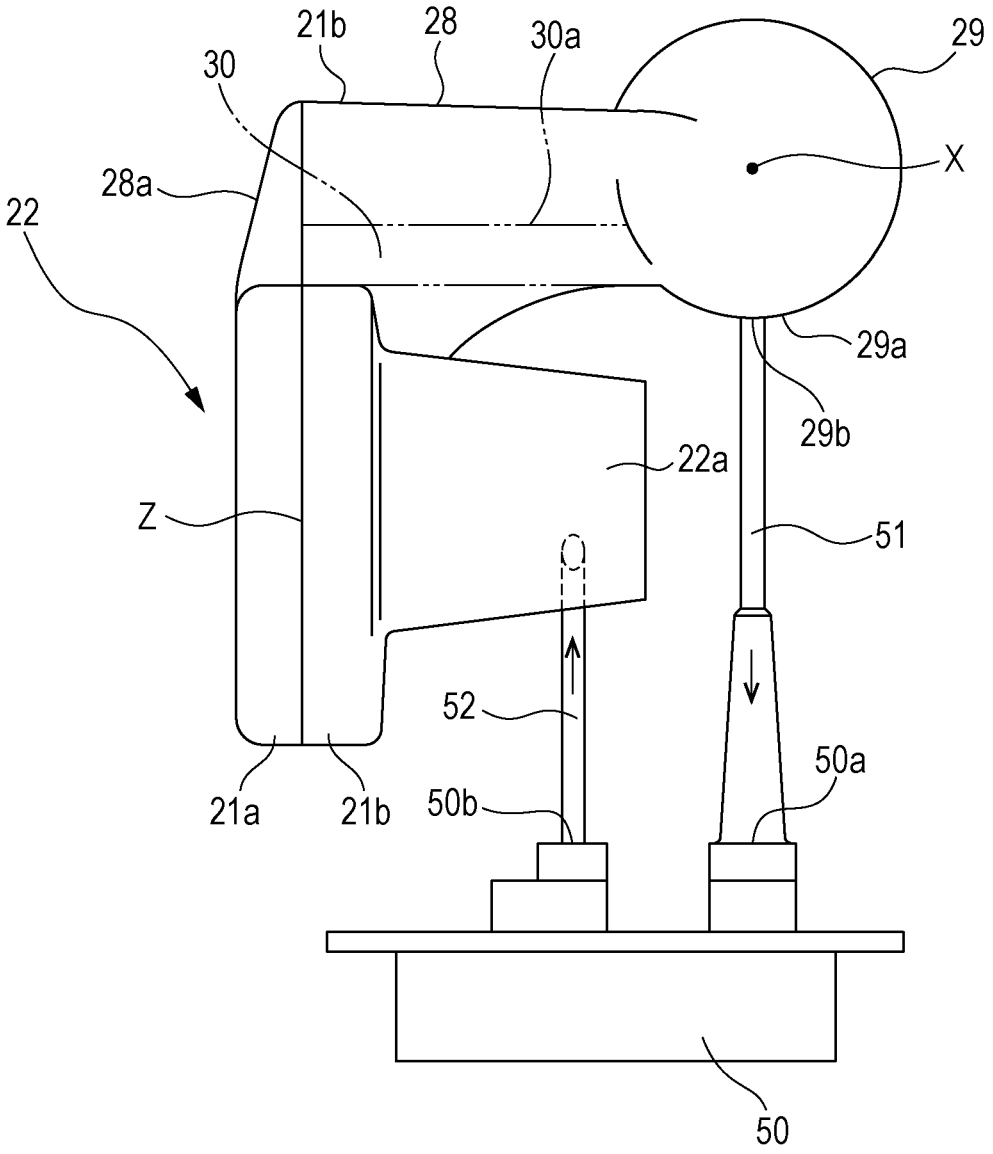
FIG. 12 is a right side view of the coolant passage illustrated in FIG. 11.

As illustrated in FIGS. 11 and 12, the oil cooler 50 is arranged below the coolant communication member 21, and a branch passage 51 for enabling coolant to be supplied to the oil cooler 50 is disposed below the same plane in the second coolant passage portion 29 as the rib top surface 30*a* of the rib 30.

As illustrated in FIGS. 11 and 12, the branch passage 51 is linear, the upstream region of the branch passage 51 is connected to a branch part 29*b* in a bottom 29*a* of the second coolant passage portion 29, and the downstream region of the branch passage 51 is connected to a coolant supply port 50*a* in the oil cooler 50. As illustrated in FIG. 11, the size of a section traversing the passage of the branch passage 51 is smaller than that of the second coolant passage portion 29.

In the present embodiment, the branch part 29*b* is disposed in the bottom 29*a* of the second coolant passage portion 29. The branch part 29*b* may be in any location other than the bottom 29*a* when it is below the same plane in the second coolant passage portion 29 as the rib top surface 30*a* of the rib 30.

As illustrated in FIG. 12, the branch passage 51 is connected to the second coolant passage portion 29 and the coolant supply port 50*a* of the oil cooler 50 such that it is orthogonal to the direction of the center line of the first coolant passage portion 28 and is also orthogonal to the direction of the center line of the second coolant passage portion 29. Because of the branch passage 51 connected like this, when the branch part 29*b* is disposed in the bottom 29*a* of the second coolant passage portion 29, the coolant flows in the branch part 29*b* at a low speed. Thus turbulence caused by the edges of the branch part 29*b* does not easily occur in the streams inside the second coolant passage portion 29, and the branch passage 51 can be connected to the oil cooler 50 without increasing the pressure drop in streams flowing in the second coolant passage portion 29.

As illustrated in FIGS. 11 and 12, an ejection passage 52 for enabling ejection of the coolant inside the oil cooler 50 is disposed between the oil cooler 50 and the centrifugal water pump 22.

The ejection passage 52 is linear and is connected to a coolant ejection port 50*b* of the oil cooler 50 and an upstream region 22*a* of the centrifugal water pump 22. Connecting the ejection passage 52 to the upstream region 22*a* of the centrifugal water pump 22 enables the coolant inside the oil cooler 50 to be efficiently ejected to the centrifugal water pump 22 using a differential pressure in the centrifugal water pump 22.

Because the branch passage 51 and the ejection passage 52 are linear, for example, they can be easily formed by opening using a drill or other tools after the oil cooler 50 and the coolant passage block 21*b* are integrally molded.

A coolant passage structure for an internal combustion engine according to a first aspect of the embodiments enables a coolant to be supplied to a coolant passage in the internal combustion engine. The coolant passage structure for the internal combustion engine includes a coolant communication member accommodating a centrifugal water pump and being attached to the internal combustion engine. The coolant communication member includes a housing portion, a scroll portion, a first coolant passage portion, and a second coolant passage portion. The housing portion accommodates an impeller of the centrifugal water pump. The scroll portion links to the housing portion and includes a downstream region connected to the first coolant passage portion. The first coolant passage portion is positioned above the downstream region of the scroll portion. The first coolant passage portion includes a downstream region connected to an upstream region of the second coolant passage portion. The second coolant passage portion is cylindrical. The second coolant passage portion includes a downstream region connected to the coolant passage in the internal combustion engine. A direction of a center line of the first coolant passage portion is parallel to a direction of a rotation shaft of the centrifugal water pump. A direction of a center line of the second coolant passage portion is orthogonal to the direction of the center line of the first coolant passage portion. A rib for adjusting the coolant flowing inside the first coolant passage portion is disposed on an internal circumferential surface thereof.

According to the coolant passage structure for the internal combustion engine in the first aspect of the embodiments, the direction of the center line of the first coolant passage portion is parallel to the direction of the rotation shaft of the centrifugal water pump, the direction of the center line of the second coolant passage portion is orthogonal to the direction of the center line of the first coolant passage portion, and the first coolant passage portion includes the rib disposed on the internal circumferential surface thereof and configured to adjust the coolant flowing inside the first coolant passage portion. As a result, there is a difference in speed between streams inside the scroll portion caused by the centrifugal force of the impeller of the centrifugal water pump. Thus, the occurrence of collisions of the streams of coolant with high speeds flowing along the internal circumferential surface of the first coolant passage portion around the center line of the first coolant passage portion is prevented by the rib. This reduces the pressure drop in streams inside the first coolant passage portion.

According to a second aspect of the embodiments, in the coolant passage structure for the internal combustion engine in the first aspect, the rib may be long and narrow and extend substantially in parallel to the center line of the first coolant passage portion.

According to the coolant passage structure for the internal combustion engine in the second aspect, the streams can be guided toward the second coolant passage portion along the rib. As a result, the occurrence of collisions of the streams can be suppressed over the direction of the center line of the first coolant passage portion, the streams can be adjusted so as to be directed toward the second coolant passage portion, and thus the pressure drop in streams inside the first coolant passage portion and the second coolant passage portion can be reduced.

According to a third aspect of the embodiments, in the coolant passage structure for the internal combustion engine in the first or second aspect, the internal circumferential surface of the first coolant passage portion may include two opposite surfaces as seen in the direction of the center line of the first coolant passage portion, one of the two opposite surfaces that is remote from the housing portion may be defined as an outer surface, the other surface opposed to the outer surface may be defined as an inner surface, and the rib may be disposed on the inner surface.

According to the coolant passage structure for the internal combustion engine in the third aspect, as seen in the direction of the rotation shaft of the centrifugal water pump, of the internal circumferential surface of the first coolant passage portion, the internal circumferential surface on a side where it is formed by extension from a tangent to the circle of the housing portion is defined as the outer surface, the surface opposed to the outer surface is defined as the inner surface, and the rib is disposed on the inner surface.

Because the rib is disposed on the inner surface in the first coolant passage portion, the occurrence of collisions of the streams inside the first coolant passage portion, where a swirling flow would easily occur, can be efficiently suppressed, and the pressure drop in streams inside the first coolant passage portion can be reduced.

According to a fourth aspect of the embodiments, in the coolant passage structure for the internal combustion engine in the third aspect, a center line of streams of the coolant flowing above the rib on the first coolant passage portion may substantially intersect the center line of the second coolant passage portion as seen in the direction of the center line of the second coolant passage portion.

According to the coolant passage structure for the internal combustion engine in the fourth aspect, the coolant flowing above the rib with high speeds flows in the central part of the second coolant passage portion, whereas the coolant flowing below the rib with low speeds flows outside the central part of the second coolant passage portion. Accordingly, the coolant flows into the second coolant passage portion without causing swirling flows, and the pressure drop in streams can be reduced.

According to a fifth aspect of the embodiments, in the coolant passage structure for the internal combustion engine in the fourth aspect, the internal combustion engine may be equipped with an oil cooler configured to exchange heat with engine oil using the coolant, a branch passage enabling the coolant to be supplied to the oil cooler may be disposed below the same plane in the second coolant passage portion as a rib top surface of the rib, and the branch passage may be connected to the second coolant passage portion and the oil cooler.

According to the coolant passage structure for the internal combustion engine in the fifth aspect, the coolant flowing below the rib with low speeds flows below the same plane in the second coolant passage portion as the rib top surface, and the coolant flowing above the rib with high speeds is less likely to flow in that area. Thus when the branch passage communicating with the oil cooler is disposed on the lower part of the second coolant passage portion, turbulence is less likely to occur in the connection between the branch passage and the second coolant passage portion, and the branch passage can be connected to the oil cooler without increasing the pressure drop in streams in the second coolant passage portion. Because turbulence is less likely to occur in the connection between the branch passage and the second coolant passage portion, the diameter of the opening in the connection can be increased, and the amount of flow of the coolant to the branch passage can be stabilized.

According to a sixth aspect of the embodiments, in the coolant passage structure for the internal combustion engine in any one of the third to fifth aspects, the rib is set such that a ratio of an amount of protrusion of the rib to a distance between the inner surface and the outer surface of the first coolant passage portion as seen in the direction of the center line of the first coolant passage portion may be in a range of 12% to 49%.

According to the coolant passage structure for the internal combustion engine in the sixth aspect, the rib is set such that the ratio of the amount of protrusion of the rib to the distance between the inner surface and the outer surface of the first coolant passage portion as seen in the direction of the rotation shaft of the centrifugal water pump may be in a range of 12% to 49%. Accordingly, the pressure drop in streams inside the first coolant passage portion can be effectively reduced.

According to a seventh aspect of the embodiments, in the coolant passage structure for the internal combustion engine in any one of the first to sixth aspects, the rib may have a substantially rectangular transverse section in any location in the direction of the center line of the first coolant passage portion.

According to the coolant passage structure for the internal combustion engine in the seventh aspect, because the streams are deflected along the transverse section shape of the rib, which has a substantially rectangular transverse section, the directions of swirling flows being opposite to each other in the coolant in the first coolant passage portion are deflected by the rib at approximately right angle. As a result, the occurrence of collisions of the streams can be suppressed, and the pressure drop in streams inside the first coolant passage portion can be reduced.

According to an eighth aspect of the embodiments, in the coolant passage structure for the internal combustion engine in any one of the first to seventh aspects, the coolant communication member may be divided into a pump block and a coolant passage block, and the rib on the first coolant passage portion may be disposed in only the coolant passage block.

According to the coolant passage structure for the internal combustion engine in the eighth aspect, cavitation or local swirling flows that would occur from a step in the part where the pump block and the coolant passage block are joined if the rib is also disposed in the pump block can be avoided, and the pressure drop in streams in the upstream region in the first coolant passage portion can be reduced.

According to a ninth aspect of the embodiments, in the coolant passage structure for the internal combustion engine in any one of the first to eighth aspects, the first coolant passage portion may include an upstream end surface, and, as seen in the direction of the center line of the second coolant passage portion, the upstream end surface may be inclined toward the downstream region of the first coolant passage portion along an upward direction from a trailing end of the scroll portion with respect to a surface of revolution of the impeller.

According to the coolant passage structure for the internal combustion engine in the ninth aspect, changes in the direction in which the coolant flows from the scroll portion to the first coolant passage portion are gradual, the occurrence of turbulence can be suppressed, and the pressure drop in streams inside the coolant passage structure can be reduced.

Obviously, numerous modifications and variations of the present invention are possible in light of the above teachings. It is therefore to be understood that within the scope of the appended claims, the invention may be practiced otherwise than as specifically described herein.

What is claimed is:

1. A coolant passage structure for an internal combustion engine, the coolant passage structure enabling coolant to be supplied to a coolant passage in the internal combustion engine, the coolant passage structure comprising:

a coolant communication member accommodating a centrifugal water pump and being attached to the internal combustion engine, wherein the coolant communication member includes a housing portion, a scroll portion, a first coolant passage portion, and a second coolant passage portion, the housing portion accommodates an impeller of the centrifugal water pump, the scroll portion links to the housing portion and includes a downstream region connected to the first coolant passage portion, the first coolant passage portion is positioned above the downstream region of the scroll portion, the first coolant passage portion includes a downstream region connected to an upstream region of the second coolant passage portion, the second coolant passage portion is cylindrical, the second coolant passage portion includes a downstream region connected to the coolant passage in the internal combustion engine, a direction of a center line of the first coolant passage portion is parallel to a direction of a rotation shaft of the centrifugal water pump, a direction of a center line of the second coolant passage portion is orthogonal to the direction of the center line of the first coolant passage portion, a rib is disposed on an internal circumferential surface of the first coolant passage portion, the rib extends substantially in parallel to the center line of the first coolant passage portion, the internal circumferential surface of the first coolant passage portion includes two opposite surfaces, one of the two opposite surfaces that is remote from the housing portion is defined as an outer surface, the other surface of the two opposite surfaces opposed to the outer surface is defined as an inner surface, and the rib is disposed on the inner surface.

2. The coolant passage structure according to claim 1, wherein the rib is long and narrow.

3. The coolant passage structure according to claim 1, wherein a center line of streams of the coolant flowing above the rib on the first coolant passage portion substantially intersects the center line of the second coolant passage portion as seen in the direction of the center line of the second coolant passage portion.

4. The coolant passage structure according to claim 3, wherein the internal combustion engine is equipped with an oil cooler configured to exchange heat with engine oil using the coolant, a branch passage enabling the coolant to be supplied to the oil cooler is disposed below the same plane in the second coolant passage portion as a rib top surface of the rib, and the branch passage is connected to the second coolant passage portion and the oil cooler.

5. The coolant passage structure according to claim 1, wherein the rib is set such that a ratio of an amount of protrusion of the rib to a distance between the inner surface and the outer surface of the first coolant passage portion when viewed in a direction along the center line of the first coolant passage portion is in a range of 12% to 49%.

6. The coolant passage structure according to claim 1, wherein the rib has a substantially rectangular transverse section in any location in the direction of the center line of the first coolant passage portion.

7. The coolant passage structure according to claim 1, wherein the coolant communication member is divided into a pump block and a coolant passage block, and the rib on the first coolant passage portion is disposed in only the coolant passage block.

8. The coolant passage structure according to claim 1, wherein the first coolant passage portion includes an upstream end surface, and, when viewed in a direction along the center line of the second coolant passage portion, the upstream end surface is inclined toward the downstream region of the first coolant passage portion along an upward direction from a trailing end of the scroll portion with respect to a surface of revolution of the impeller.

9. The coolant passage structure according to claim 1, wherein the rib is made of a single member.

10. The coolant passage structure according to claim 1, wherein the rib extends to a location within a curved region that connects the downstream region of the scroll portion with an upstream region of the first coolant passage portion.

11. The coolant passage structure according to claim 1, wherein the rib extends to a location that overlaps with the downstream region of the scroll portion when viewed in a flow direction of the downstream region of the scroll portion.

12. A coolant passage structure for an internal combustion engine, comprising:

a coolant communication member comprising:

a centrifugal water pump;

a housing portion accommodating an impeller of the centrifugal water pump;

a scroll portion connected to the housing portion and including a downstream region;

a second coolant passage portion being cylindrical and including a downstream region connected to a coolant passage in the internal combustion engine, the coolant passage structure being configured to supply coolant to the coolant passage;

a first coolant passage portion including a downstream region connected to an upstream region of the second coolant passage portion, the downstream region of the scroll portion being connected to the first coolant passage portion which is positioned above the downstream region of the scroll portion, a direction of a center line of the first coolant passage portion being parallel to a direction of a rotation shaft of the centrifugal water pump;

a direction of a center line of the second coolant passage portion being orthogonal to the direction of the center line of the first coolant passage portion; and a rib disposed on an internal circumferential surface of the first coolant passage portion.

13. The coolant passage structure according to claim 12, wherein the rib is long and narrow and extends substantially in parallel to the center line of the first coolant passage portion.

14. The coolant passage structure according to claim 12, wherein the internal circumferential surface of the first coolant passage portion includes two opposite surfaces as seen in the direction of the center line of the first coolant passage portion, one of the two opposite surfaces that is remote from the housing portion is defined as an outer surface, another surface opposed to the outer surface is defined as an inner surface, and the rib is disposed on the inner surface.

15. The coolant passage structure according to claim 14, wherein a center line of streams of the coolant flowing above the rib on the first coolant passage portion substantially intersects the center line of the second coolant passage portion when viewed in a direction along the center line of the second coolant passage portion.

16. The coolant passage structure according to claim 15, wherein the internal combustion engine has an oil cooler configured to exchange heat with engine oil using the coolant, a branch passage enabling the coolant to be supplied to the oil cooler is disposed below a same plane in the second coolant passage portion as a rib top surface of the rib, and the branch passage is connected to the second coolant passage portion and the oil cooler.

17. The coolant passage structure according to claim 16, wherein a size of a section traversing a passage of the branch passage is smaller than a size of a section traversing a passage of the second coolant passage portion.

18. The coolant passage structure according to claim 14, wherein the rib is set such that a ratio of an amount of protrusion of the rib to a distance between the inner surface and the outer surface of the first coolant passage portion as seen in the direction of the center line of the first coolant passage portion is in a range of about 12% to about 49%.

19. The coolant passage structure according to claim 12, wherein the rib has a substantially rectangular transverse section in any location in the direction of the center line of the first coolant passage portion.

20. The coolant passage structure according to claim 12, wherein the coolant communication member is divided into a pump block and a coolant passage block, and the rib on the first coolant passage portion is disposed in only the coolant passage block.

21. The coolant passage structure according to claim 12, wherein the first coolant passage portion includes an upstream end surface, and, when viewed in a direction along the center line of the second coolant passage portion, the upstream end surface is inclined toward the downstream region of the first coolant passage portion along an upward direction from a trailing end of the scroll portion with respect to a surface of revolution of the impeller.

22. The coolant passage structure according to claim 12, wherein the rib extends upward or downward toward the downstream region of the first coolant passage portion inside the first coolant passage portion as seen in the direction of the center line of the second coolant passage portion.

* * * * *